US005660973A

United States Patent [19]

Ishikawa et al.

[11] Patent Number: 5,660,973

[45] Date of Patent: Aug. 26, 1997

[54] DEVELOPING MACHINE AND DEVELOPING METHOD FOR COLOR PHOTOGRAPHY

[75] Inventors: Takatoshi Ishikawa, Minami-Ashigara; Fumio Mogi, Kanagawa-Ken, both of Japan

[73] Assignee: Fuji Photo Film Co., Ltd., Minami-Ashigara, Japan

[21] Appl. No.: 404,584

[22] Filed: Mar. 15, 1995

[30] Foreign Application Priority Data

Mar. 18, 1994 [JP] Japan ..... 6-048997

[51] Int. Cl.[6] ..... G03D 13/04; G03D 3/00; G03C 7/407

[52] U.S. Cl. ..... 430/444; 430/466; 430/963; 206/578; 206/524.5; 396/571; 396/564; 396/636; 396/641; 396/638

[58] Field of Search ..... 430/444, 466, 430/963; 206/578, 524.5; 354/297, 299, 331, 333, 336; 396/571, 564, 636, 641, 638

[56] References Cited

U.S. PATENT DOCUMENTS

| | | | |
|---|---|---|---|
| 4,954,838 | 9/1990 | Nakamura et al. | 354/331 |
| 5,176,987 | 1/1993 | Nakamura et al. | 430/963 |
| 5,180,656 | 1/1993 | Kobayashi et al. | 430/963 |
| 5,217,854 | 6/1993 | Abe | 206/578 |
| 5,384,233 | 1/1995 | Kuse et al. | 206/578 |
| 5,432,581 | 7/1995 | Patton et al. | 354/331 |

*Primary Examiner*—Mark F. Huff

*Attorney, Agent, or Firm*—Burns, Doane, Swecker & Mathis, LLP

[57] ABSTRACT

A developing machine having a high durability at a high temperature even in the presence of a high concentration of the developing agent is provided. The developing machine has means for keeping the temperature of a color developer having a concentration of an aromatic primary amine developing agent of 0.15 to 0.50 mol/l in the range of 40° to 50° C., and the material for at least one of the developing tanks and the racks is a resin selected from the group consisting of polyphenylene sulfide resin, polyphenylene oxide resin, polymethylpentene resin, polyether ether ketone resin, polyalkylene terephthalate resin, polyether imide resin, polyether sulfone resin and polysulfone resin.

15 Claims, 3 Drawing Sheets

STRESS RELAXATION CURVE

DEVELOPING MACHINE AND DEVELOPING METHOD FOR COLOR PHOTOGRAPHY

BACKGROUND OF THE INVENTION

The present invention relates to a processing machine for a silver halide photosensitive material for color photography and a developing method for a color photography using the processing machine.

In processing silver halide photosensitive materials, so-called "mini-labs" for processing the materials within the shops have spread recently, and the time necessitated for finishing the printing of color negative films has been reduced to about 30 minutes to 1 hour. Thus, the service for the clients is now being improved. The important factors for the reduction of time necessitated for the finish are supposed to be improvement of the capacity of the machine, reduction of the processing time, reduction of the make-over rate by improving the printing accuracy and so on.

Since shortening of the processing time contributes very much to the reduction of the time for finish and also to the possibility of reduction in size of the processing machine, the various investigations have been made for developing a technique of reducing the time necessitated for the development, desilverization, washing with water, stabilization and drying steps. It is extremely effective to reduce the time necessitated for the development step among these steps, since the reduction of time without imparing the photographic properties is possible in this step by elevating the processing temperature and increasing the concentration of the developing agent.

In the conventional apparatuses for the mini-labs, the development temperature was usually about 35° to 38° C., and the concentration of the developing agent was about 0.1 mol/l. Polyvinyl chloride, stainless steel or the like is often used for tanks and racks of such processing machine due to the cost and easy processability.

However, it has been found that when a p-phenylenediamine developing agent having a concentration of 0.15 mol/l or above is used in such a processing machine at a temperature of 40° C. or higher, the members of the machine are deformed and therefore the toughness and durability of them are reduced. Such defects are caused probably by an increase of the linear expansion due to the high temperature and the deterioration of the resin due to the developing agent of the high concentration.

Supposedly, the deformation is accelerated by the temperature of 40° C. or above which is higher than the ordinary development temperature and, in particular, the degree of the deformation is increased to an extent higher than the expectation, since when the parts are immersed in the alkaline developer having a pH of at least 10, the substantial coefficient of linear expansion increases. The reduction in the strength and durability is caused because the developing agent is partially oxidized with oxygen in the presence of the developing agent of a high concentration and, thereby, oxygen is reduced to form hydrogen peroxide, which oxidizes and thereby deteriorates the parts. It is thus supposed that the parts are seriously deformed and deteriorated by the synergistic effect of the high temperature and the high concentration of the developing agent.

SUMMARY OF THE INVENTION

Therefore, an object of the present invention is to provide a processing machine having an excellent durability even at a high temperature and even in contact with the high concentration of the developing agent.

Another object of the invention is to provide a processing machine which can be easily recycled after using it.

Another object of the invention is to provide a method for processing a silver halide photosensitive material for color photography by use of the above-mentioned processing machine.

These and other objects of the invention will be apparent from the following description and examples.

It has been found that the above-described objects can be attained by the following means. That is, first aspect of the invention privides a developing apparatus for color photography having at least a developing tank and a rack, which comprises means for keeping the temperature of a color developer having a concentration of an aromatic primary amine developing agent of 0.15 to 0.50 mol/l in the developing tank in the range of 40° to 50° C., the material for at least one of the developing tank and the rack being a resin selected from the group consisting of polyphenylene sulfide resin, polyphenylene oxide resin, polymethylpentene resin, polyether ether ketone resin, polyalkylene terephthalate resin, polyether imide resin, polyether sulfone resin and polysulfone resin, The second aspect of the invention provides a method for processing a silver halide photosensitive material for color photography wherein an image-exposed silver halide photosensitive material for color photography is processed with the above-mentioned developing apparatus for color photography.

Figure 1:
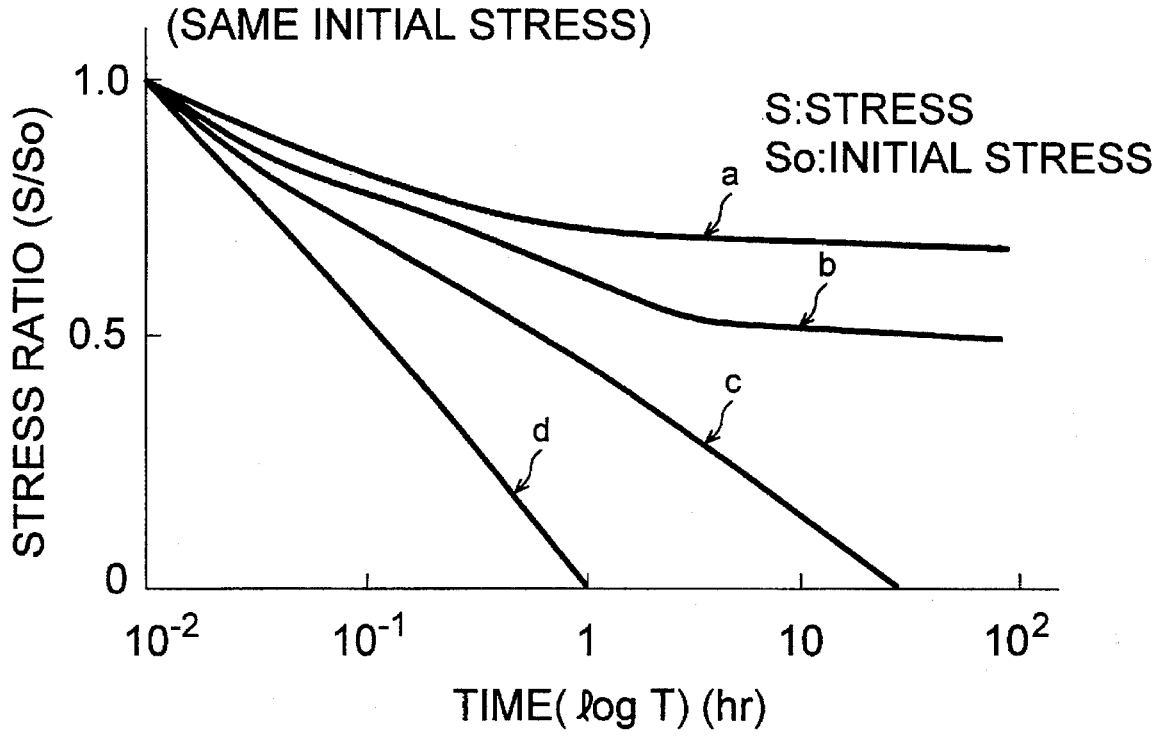
FIG. 1 shows stress relaxation curves of resins used as a material for the machine, in which the abscissae indicate the time (hr) and the ordinates indicate the stress ratio (S/So).

a, b, c and d: patterns of stress relaxation,

10: automatic processing machine,

16: floor surface,

20: developing tank,

22: bleaching tank,

24: fixing tank,

26 and 28: washing-with-water tank,

30: stabilizing tank,

32: processing tank,

33: processing rack,

34: film-mounting part,

36: cartridge,

40: color negative film, and

47: carrier roller.

DESCRIPTION OF THE PREFERRED EMBODIMENTS

The developing apparatus of the present invention may have processing tanks usable for developing the photosensitive material in addition to the developing tank. The processing tanks include, for example, bleaching tank, fixing tank, bleach-fixing tank, washing-with-water tank and stabilizing solution tank. The developing apparatus may further contain have some ordinary means, for example, carrier means for the photosensitive material necessitated for autodeveloping apparatus such as a replenisher tank and temperature-control means in addition to the rack.

It is preferred that the developing apparatus has a means for controlling the temperature at a predetermined point in the range of 40° to 50° C. in addition to a means for maintaining the temperature in this range. Examples of the means include a heater and thermostat.

The detailed description will be made on the resins usable in the present invention.

The polyphenylene oxides (PPO) are those usually called Noryl or modified PPO and polyphenylene ethers (PPE) usually called XYRON, IUPIACE or modified PPE. Preferred structure of them are represented by the following general formula (I):

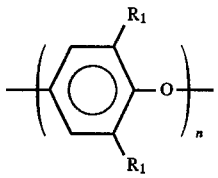

wherein $R_1$ represents a hydrogen atom, alkyl group having 1 to 3 carbon atoms or halogen atom, methyl group being the most preferred, and n represents an integer of 10 to 1,000,000. They include also styrene-grafted polyphenylene ether resins (modified PPE) which mainly comprise the structure of the general formula (I) and which have been modified with styrene, and polymer alloys of the resin of the above general formula (I) with a polystyrene resin, polyamide resin, polyalkylene terephthalate resin, fluorine resin, polyolefin resin or ABS resin. If necessary, an inorganic fiber such as glass fiber may be mixed in the resin of the general formula (I).

These resins are available on the market under trade names of "XYRON" (a product of Asahi Chemical Industry Co., Ltd.), "Noryl" (Nippon G. E. Plastics), "IUPIACE" (Mitsubishi Gas Chemical Company, Inc.), or the like.

The polyphenylene sulfides (PPS) are excellent in both acid resistance and alkali resistance. They have preferably a structure of the following general formula (II):

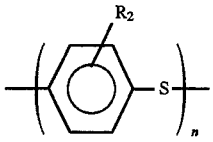

wherein $R_2$ represents a hydrogen atom, alkyl group having 1 to 3 carbon atoms or halogen atom, the hydrogen atom being the most preferred, and n represents an integer of 10 to 1,000,000. If necessary, an inorganic fiber such as glass fiber may be mixed in the PPS of the general formula (II) so as to improve the strength.

These resins are available on the market under trade names of "ASAHI-PPS" and "RYTON" (products of Asahi Glass Co., Ltd.), "Shin-Etsu PPS" (Shin-Etsu Polymer Co., Ltd.), "DIC PPS" (Dainippon Ink and Chemicals, Inc.), "Toray PPS resin" (Toray Industries, Ltd.) and "RYTON" and "SUSTEEL" (Hodogaya Chemical Co., Ltd.).

The polymethylpentenes which are also called "methylpentene polymers" (TPX and PMP). Preferred are poly(4-methylpentene)s of the following general formula (III):

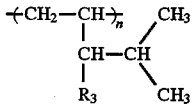

wherein $R_3$ represents a hydrogen atom, hydroxyl group or halogen atom, the hydrogen atom being the most preferred, and n represents an integer of 10 to 1,000,000.

The resin can be copolymerized with various comonomers in order to improve the properties and processability of the polymer. Typical comonomers include ethylene, propylene, butene, hexene-1, styrene and α-olefins.

These resins are available under a trade name of "TPX" (Mitsui Petrochemical Industries, Ltd.).

The polyether ether ketones are also called "PEEK". They preferably have a structure of the following general formula (IV):

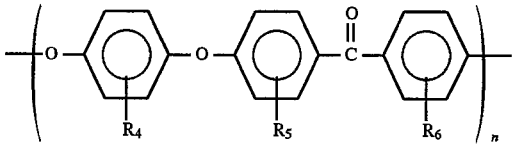

wherein $R_4$, $R_5$ and $R_6$ may be the same or different from one another and each represent a hydrogen atom, hydroxyl group, halogen atom or alkyl group having 1 to 3 carbon atoms, the hydrogen atom being the most preferred, and n represents an integer of 10 to 1,000,000.

If necessary, an inorganic fiber such as glass fiber may be mixed in the PEEK of the general formula (IV) so as to improve the strength.

These resins are available under a trade names of "VICTREX PEEK" (ICI Japan), "SUMIPLOY K" (Sumitomo Chemical Co., Ltd.) and "Peek" (Mitsui Toatsu Chemicals, Inc.).

The polyalkylene terephthalates preferably have a structure of the following general formula (V):

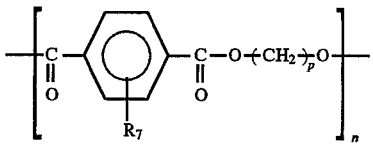

wherein P represents an integer of 1 to 5, preferably 2 or 4, and most preferably 4, $R_7$ represents a hydrogen atom, hydroxyl group, halogen atom or alkyl group having 1 to 3 carbon atoms, the hydrogen atom being the most preferred, and n represents an integer of 10 to 1,000,000.

When P is 2, the compound is called "polyethylene terephthalate" (PETP or PET) which is put on the market by many textile makers.

When P is 4, the compound is called "polybutylene terephthalate (PBTP or PBT) and available on the market under names of "VALOX" (Engineering Plastics), "PLANAC" (Dainippon Ink and Chemicals, Inc.), "Toray PBT resin" (Toray industries, Inc.), "Teijin PBT resin" (Teijin Ltd.), "NOVADUR" (Mitsubishi Chemical Industries Ltd.) or "TUFPET PBT" (Mituibishi Rayon Co., Ltd.).

The polyether imides which are called "PEI" are polymers having an imido bond. Preferred are polymers of the following general formula (VI):

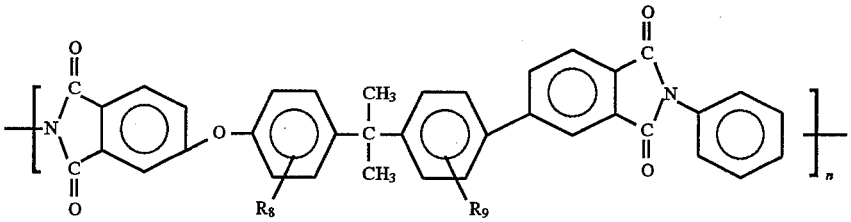

wherein $R_8$ and $R_9$ may be the same or different from each other and each represent a hydrogen atom, hydroxyl group, halogen atom or alkyl group having 1 to 3 carbon atoms, the hydrogen atom being the most preferred, and n represents an integer of 10 to 1,000,000.

If necessary, glass fiber may be mixed in the polymer to improve the strength. This resin is available under a name of "ULTEM" (Engineering Plastics).

The polyether sulfones which are called "PES" or "PESF" are aromatic polysulfone resins. Preferred are those mainly comprising polymers of the following general formula (VII):

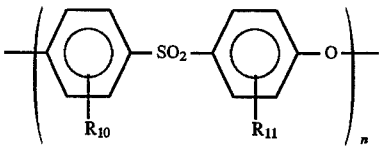

wherein $R_{10}$ and $R_{11}$ may be the same or different from each other each represent a hydrogen atom, hydroxyl group, halogen atom or alkyl group having 1 to 3 carbon atoms, the hydrogen atom being the most preferred, and n represents an integer of 10 to 1,000,000.

If necessary, glass fiber may be mixed in the polymer to improve the strength. This resin is available under a name of "VICTREX PEEK" (ICI Japan), "SUMIPLOY K" (Sumitomo Chemical Co., Ltd.) or "PES" (Mitsui Toatsu Chemicals, Inc.).

The polysulfon resins include also polysulfones which are called "PSF". Preferred are those mainly comprising polymers of the following general formula (VIII):

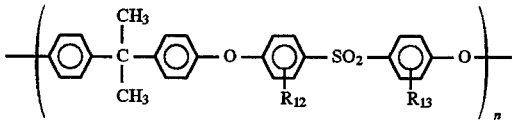

wherein $R_{12}$ and $R_{13}$ may be the same or different from each other each represent a hydrogen atom, hydroxyl group, halogen atom or alkyl group having 1 to 3 carbon atoms, the hydrogen atom being the most preferred, and n represents an integer of 10 to 1,000,000.

If necessary, glass fiber may be mixed in the polymer to improve the strength. This resin is available under a name of "UDEL" (AMOKO Japan Ltd.) or "Ultrason S" (BASF Engineering Plastic). This resin is suitable for use as a material for members such as springs in the rack, taking advantage of its high flexural modulus.

Among the above-described resins, the polyphenylene oxide, polyphenylene sulfide and polymethylpentene are particularly preferably in the present invention from the viewpoint of the durability.

The resins selected as described above exert no bad influence on the photograhic properties (such as sensitivity and fog) of the photosensitive material. These three kinds of resins are particularly excellent in this point.

The detailed description will be made on the processing tank used in the present invention.

The processing tank of the processing apparatus for the photosensitive material is produced mainly by a method wherein a rigid vinyl chloride resin plate is cut, and the pieces thus obtained are assembled by welding. This method is frequently employed, since it is suitable for the production of various tanks in a small scale. However, the satisfactory surface finish is impossible at a bonded part and welded part of the material and, therefore, the surface is rough. This causes the rising of the processing solution along the wall and deposition thereof and as a result, there are produced staining of the processing tank and contamination with a solution from another processing bath. This method has other defects such as a high production cost due to many production steps, a low dimensional accuracy and difference of the tanks from each other because the tanks are fabricated separately from each other.

In order to overcome these defects, another method is also conducted wherein some parts are formed in □-shape, ▽-shape or S-shape by molding and combined from one another. In the present invention, it is preferred to employ a method wherein the bonded part or welded part is not positioned at a part in which the interface of the processing solution is located as in the method of preparing the □-shaped piece even when the parts are combined by extrusion molding. The material for the processing tank produced by this method, which is practically employed at present, is a polyvinyl chloride resin. Extrusion-molded products of the polyvinyl chloride resin are unsuitable for the color developer of the present invention, since the material slurface has wrinkles formed by the nozzle in the extrusion molding step and is rough.

In order to smoothen the rough surface of the extrusion-molded polyvinyl chloride, several % of an acrylic resin is added to the polyvinyl chloride in the art. Further, a denatured soybean oil is added to the polyvinyl chloride to improve the moldability thereof. However, when such a modified resin is exposed to the developer of the present invention at a temperature of as high as 40° C. or higher for a long period of time, the deformation by creep is serious and, in addition, the durability of the resin against the color developing agent is insufficient.

Further, the rigid polyvinyl chloride to be extrusion-molded comprises the straight polymer and various additives used for improving the moldability and stability. When a heavy metal compound such as Ca/Pb stearate, lead stearate or liquid Ba-Zn stabilizer is incorporated into the polyvinyl chloride, it is difficult to treat the tank as waste and, therefore, the used tank is usually buried in the earth. The recycle of polyvinyl chloride resins is difficult, since the compositions thereof are various.

It was tried to produce a tank for the color developer of the present invention by injection-molding of the polyvinyl chloride resin. In this experiment, it was found that the production of a large molding like the processing tank by the injection molding of the polyvinyl chloride is practically disadvantageous, since chlorine gas is formed in the course of the molding to corrode the mold and molding equipments to increase the equipment cost.

Thus, it is very difficult to select a material having excellent resistance to chemicals such as the color developer of the present invention and physical and chemical stability at a high temperature for a long period of time.

After intensive investigations including repeated experiments, the inventors have found that a polymer material having a skeletal structure given by the present invention is suitable. A resin material is selected from the group consisting of a polyphenylene oxide resin, polyphenylene sulfide resin, polymethylpentene resin, polyether ether ketone resin, polyalkylene terephthalate resin, polyether imide resin, polyether sulfone resin and polysulfone resin, since these resins are not hydrolyzed or deteriorated even when the color developer has a pH of 10.0 or above; these have an excellent dimensional stability and these are not deformed or corroded even at a temperature of 40° C. or above; these are resistant to staining; these are not easily crystallized; and these are relatively inexpensive. Among these resins, the most preferred are polyphenylene oxide, polyphenylene sulfide and polymethylpentene.

The tank suitable for the present invention may be composed of a bottom pare, side wall and lid, and further may have an inlet and an outlet for an image-wise exposed silver halide photographic material. The bottom part and/or side wall may be made of the resin mentioned above. In addition, it is preferable that the lid be made from the resin. The tank is produced by various injection-molding methods with an injection-molding machine. When the tank is small, an ordinary injection-molding method is employed. This is a relatively easy method, since the resin in the solid form can be molded and, therefore, the formed molding has the smooth surface even when an ordinary molding machine is used. Various foam molding methods and blow molding methods can be employed so as to obtain a large tank or to obtain a heat-insulating tank. In these methods, the formation of sink marks and warpage in the course of forming a large tank can be prevented by forming a foam layer or hollow layer in the molding and, therefore, the molding accuracy and the surface smoothness of molding can be improved.

As for specific molding methods, a low expansion molding (SF molding) method recommended by Nippon G. E. Plastics Co., Ltd. and NEW-SFL molding (NEW-SF) method of Asahi Chemical Industry Co., Ltd. can be mentioned. In a full shot method, the whole thickness molding can be conducted by a counter presure method developed by Nippon G. E. Plastic Co., Ltd. and Nippon Steel Chemical Co., Ltd. In an injection blow molding method for partial thickness molding by a short shot method, AGI molding method of Asahi Chemical Industry Co., Ltd. or CINPRESS molding method developed by PEERLESS FOAM MOLDING (England) can be employed. PFP molding method of Nippon Steel Chemical Co., Ltd. can be employed for the full shot method for the partial thickness molding.

The tank of the present invention is produced by one of these molding methods, or the tank can also be produced by forming parts by several molding processes and assembling the parts together. After the molding, the resins can be adhered or welded together. Among these molding methods, those particularly suitable for producing the tank are low expansion molding methods such as SF molding and NEW-SFL molding methods. Since pores are formed in a gate part (hollow part containing a gas sealed therein) and the processing solution might penetrate into the molding when it is used as the tank, it is preferred to stop up it, if necessary.

In the present invention, the smoother the surface of the tank thus molded, the better. When the surface is rough, the color developing agent having a high concentration easily deposits thereon and, in addition, various chemicals easily deposit by the evaporation because of the high processing temperature, thereby staining the tank. Such a stain will also cause the staining of the photosensitive material or the transportation troubles or flaw of the material. The preferred surface roughness in the present invention is such that the center line roughness (Ra) is 5 μm or below and the maximum roughness (Rmax) is 50 μm or below. "Ra" herein indicates the distance between the average surface level and the average level or level. This value means the average roughness. "Rmax" indicates the maximum distance from the average surface level. The details are defined in JIS B 0601-1982, and the roughness can be determined according to the specification thereof. Specifically, the roughness can be easily determined with, for example, SURCOM 575A (a machine for measuring surface roughness and shape; a product of Tokyo Seimitsu Co., Ltd.). Ra is preferably 0 to 4 μm and Rmax is preferably 30 μm or below in the present invention.

The surface of the tank thus produced can be smoothened by a chemical paper treatment (chemical polishing treatment) in which the surface is dissolved with a solvent or by coating with a resin.

The thickness of the tank is preferably 3 to 30 mm, more preferably about 4 to 30 mm, in the present invention. The term "thickness" herein indicates the average thickness, and the tank may have thinner portions, of course. It has been found that when the tank is used at a temperature of 40° C. or higher, the stress concentration is caused by the linear expansion and a stress higher than an expected one is partially applied. Further, when the tank is brought into contact with an alkali solution having a pH of 10 or above, the stress crack formation is further accelerated. Thus, the thickness of the tank is preferably at least 3 mm. A thickness thereof exceeding 30 mm is undesirable from the viewpoints of the cost and weight.

The rack may comprise means for carrying an image-wise exposed silver halide photosensitive material such as a carrier roller, gruide, gear, sprocket, spindle, screw, large roller, small roller or the like.

Although the conditions required of the members of the processing rack are basically the same as those of the members of the tank, the thickness thereof is not particularly limited, since the whole weight of the processing solution is not applied thereto unlike the processing tank. However, resins frequently used as the material for the processing racks such as polyvinyl chloride, high-density polyethylene, polypropylene and nylon are unsuitable for the use for a long period of time, since when they are brought into contact with the color developer of 40° C. or higher as in the present invention, serious dimensional change and load change are caused by the high linear expansion. The inventors have found that the materials suitable for particularly the side plate of the rack are a polyphenylene oxide, polyphenylene sulfide, polymethylpentene, polyether ether ketone, polyalkylene terephthalate, polyether imide, polyether sulfone and polysulfone. If necessary, a reinforcing agent such as glass fiber can be incorporated thereinto.

The material suitable for a gear or sprocket for the rack is selected from the group consisting of a polyphenylene oxide, polyether etherketone, polyalkylene terephthalate and polyetherimide. If necessary, a reinforcing agent such as glass fiber can be incorporated thereinto.

The material suitable for a member (such as a resin spring) of which spring properties are required in a nip or guide of a roller is a polyether sulfone, polysulfone or polyether ether ketone having excellent creep properties at a high temperature.

A polymethylpentene having a low specific gravity and a low rotation load is usable as a material for the roller. A spindle and screws usually made of a metal can be replaced with those made of a resin selected from among those set forth in Claim 1. For example, a screws produced by molding a polyetherimide or polyether ether ketone are usable. A PEEK screw put on the market by Smith Co., Ltd. is also usable.

The durability of such a material is desirably determined by a so-called running test wherein the processing machine is actually produced and the photosensitive material is continuously processed with it. However, a long period of time and a heavy operation load are necessary for continuing the running test until the end of the life of the processing machine, and such a long-term test is difficult. It is not easy to judge whether the resin used is suitable or unsuitable in the deterioration test of the machine of the present invention with the color developer, since the resin does not exhibit a sudden and marked change. It is desirable, therefore, to conduct an accelerated test most suitable for each part. Parts such as roller and guide to which substantially no load is applied in the practical use are immersed in the solution having a temperature slightly higher than the actual temperature, and the changes thereof in the dimension, weight and strength with time are examined. The immersion test may be conducted according to JIS K 7114. In the strength test, the tensile strength, bending strength at breaking and modulus of elasticity are determined according to JIS K 7113 and JIS K 7203. The determination is conducted at predetermined time intervals until changes in the properties have become very small and stable. When a material unsuitable for the present invention is tested, the properties are deteriorated to a level below a predetermined, necessary level, and then the test is no more continued.

Polyvinyl chloride or the like cannot be judged by the above-described test in some cases. The above-described test is a static test wherein the resistance to chemicals are determined without any load, which is a condition necessary but insufficient for resisting the color developing process of the present invention. To compensate for this point, a chemical resistance test under stress according to JIS K 7107 or JIS K 7108 is necessitated. By this test, it is understood that the polyvinyl chloride does not have the necessitated properties. Specifically, it is recommended to conduct the test with Yamazaki Stress Relaxation tester YSR-8 (a product of Yamazaki Seiki Kenkyujo) which has a structure based on a stress relaxation tester of force-detecting type according to JIS K 7107 (1986), 4-1. It is desirable to conduct the test with the processing solution, process temperature and necessary load applied to the machine (which varies depending on the part; and the factor of safety concerning the scattering of molding and stress concentration must be involved) by using the tester.

Then the test sample is fixed on a given bending strain jig and the processing solution is applied to the sample by a so-called ¼ ellipse method, or the above-described immersion test is conducted. The strain applied to the material by the bending strain jig is determined from the radius of curvature, and the critical stress of the material can be determined from the Young's modulus-in-flexure of the material by Hooke's low. Although this test method is effective for parts such as gears and sprockets to which a high load is applied, the above-described stress relaxation test is also necessary for evaluating the shape stability during the use for a long period of time.

The description will be made on the color developer used in the present invention.

The color developer used in the processing apparatus of the present invention contains a well-known aromatic primary amine as the color developing agent. Preferred examples of these amines include p-phenylenediamine derivatives typified by N,N-diethyl-p-phenylenediamine, 2-amino-5-diethylaminotoluene, 2-amino-5-(N-ethyl-N-laurylamino)toluene, 3-methyl-4-[N-ethyl-N-(β-hydroxyethyl)amino]aniline, 3-methyl-4-[N-ethyl-N-(δ-hydroxybutyl)amino]aniline, 2-methyl-4-[N-ethyl-N-(β-hydroxyethyl)amino]aniline, 4-amino-3-methyl-N-ethyl-N-(β-methanesulfonamido)ethyl]-aniline, N-(2-amino-5-diethylaminophenylethyl)methanesulfonamide, N,N-dimethyl-p-phenylenediamine, 4-amino-3-methyl-N-ethyl-N-methoxyethylaniline, 4-amino-3-methyl-N-ethyl-N-β-ethoxyethylaniline and 4-amino-3-methyl-N-ethyl-N-β-butoxyethylaniline. Particularly preferred are 4-amino-3-methyl-N-ethyl-N-(β-methanesulfonamido)ethyl]-aniline, 2-methyl-4-[N-ethyl-N-(β-hydroxyethyl)amino]aniline and 2-methyl-4-[N-ethyl-N-(δ-hydroxybutyl)amino]aniline.

Particularly remarkable effect of the present invention can be obtained when 4-amino-3-methyl-N-ethyl-N-[(β-methanesulfonamido) ethyl]-aniline or 3-methyl-4-[N-ethyl-N-(β-hydroxyethyl)amino]aniline is used among the above-described compounds.

The p-phenylenediamine derivatives may be in the form of sulfate, hydrochloride, sulfite or p-toluenesulfonate thereof. The aromatic primary amine as the developing agent is used in an amount of about 0.15 to 0.5 mol/l, preferably 0.17 to 0.50 mol/l, per liter of the color developer. The color developing replenisher is used in such an amount that the color developing agent is in an amount of preferably about 0.17 to 0.60 mol, more preferably about 0.2 to 0.8 mol, per liter of the replenisher. When the concentration of the color developing agent exceeds 0.5 mol/l, a problem of the solubility might occur.

In conducting the present invention, it is preferred to use a color developer substantially free from benzyl alcohol so as to further improve the durability of the materials of the apparatus. The term "substantially free from benzyl alcohol" indicates that the benzyl alcohol concentration is preferably 2 ml/l or below, more preferably 0.5 ml/l or below, and most preferably 0 (zero).

The color developer used in the present invention can contain a hydroxylamine and sulfite ion, and it preferably contains an organic preservative.

The term "organic preservative" herein indicates all the organic compound capable of reducing the deterioration velocity of the aromatic primary amine color developing agent when it is added to the solution for processing the photosensitive material for color photography. Namely, they are organic compounds having a function of preventing the oxidation of the color developing agent with air or the like. Particularly effective preservatives are hydroxylamine derivatives (exclulding hydroxylamine), hydroxamic acids, hydrazines, hydrazides, phenols, α-hydroxyketones,α-aminoketones, saccharides, monoamines, diamines, polyamines, quaternary ammonium salts, nitroxy radicals, alcohols, oximes, diamide compounds and amines having condensed rings. Particularly preferred are alkanolamines such as triethanolamine; dialkylhydroxylamines such as N,N-diethylhydroxylamine and N,N-di(sulfoethyl) hydroxylamine; hydrazine derivatives (excluding hydrazine) such as N,N-bis(carboxymethyl)hydrazine and aromatic polyhydroxy compounds such as sodium catechol-3,5-disulfonate.

The black-and-white or color developer used in the present invention may contain an antifoggant, if necessary. Examples of antifoggants include alkali metal halides such as sodium chloride, potassium bromide and potassium iodide, and organic antifoggants. The organic antifoggants are typified by nitrogen-containing heterocyclic compounds such as benzotriazole, 6-nitrobenzimidazole, 5-nitrosoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

The effect of the present invention can be remarkably exhibited when the pH of the developer of the present invention is 10.0 or above, preferably in the range of 10.20 to 11.00. The developer can contain other known compounds used as the components of the developer.

To keep the pH in the above-described range, a buffering agent is preferably used. The buffering agents include, for example, carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lysine salts. Particularly preferred are carbonates and phosphates.

The amount of the buffer to be added to the developer is preferably at least 0.1 mol/l, particularly in the range of 0.1 mol/l to 0.4 mol/l.

The developer can further contain a chelating agent for inhibiting the precipitation of calcium and magnesium or for improving the stability of the color developer. The chelating agents include, for example, nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycol etherdiaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl) ethylenediamine-N,N'-diacetic acid and hydroxyethyliminodiacetic acid. These chelating agents can be used in combination of two or more of them, if necessary.

The chelating agent is used in an amount sufficient for the sequestering in the developer. The amount is, for example, about 0.1 to 10 g per liter.

A development accelerator can be added, if necessary, to the developer used in the present invention.

The development accelerators include, for example, thioether compounds described in Japanese Patent Publication for Opposition Purpose (hereinafter referred to as "j. P. KOKOKU") Nos. Sho 37-16088, 37-5987, 38-7826, 44-12380 and 45-9019 and U.S. Pat. No. 3,813,247; p-phenylenediamine compounds described in Japanese Patent Unexamined Published Application (hereinafter referred to as "J. P. KOKAI") Nos. Sho 52-49829 and 50-15554; quaternary ammonium salts described in J. P. KOKAI No. Sho 50-137726, J. P. KOKOKU No. Sho 44-30074 and J. P. KOKAI Nos. 56-156826 and 52-43429; amine compounds described in U.S. Pat. Nos. 2,494,903, 3,128,182, 4,230,796 and 3,253,919, J. P. KOKOKU No. Sho 41-11431, and U.S. Pat. Nos. 2,482,546, 2,596,926 and 3,582,346; polyalkylene oxides described in J. P. KOKOKU Nos. Sho 37-16088 and 42-25201, U.S. Pat. No. 3,128,183, J. P. KOKOKU Nos. Sho 41-11431 and 42-23883 and U.S. Pat. No. 3,532,501; as well as 1-phenyl-3-pyrazolidones and imidazoles. The benzyl alcohol is as described above.

The color developer usable in the present invention preferably contains a fluorescent brightener. The fluorescent brightener is prteferably a 4,4'-diamino-2,2'-disulfostilbene compound. It is used in an amount of 0 to 5 g/l, preferably 0.1 to 4 g/l.

The developer used in the present invention is replenished in an amount of 20 to 1,000 ml, preferably 30 to 300 ml, per $m^2$ of the photosensitive material.

The effect of the present invention can be remarkably exhibited at a processing temperature of 40° to 50° C. Particularly, at 42° to 50° C., the excellent durability of the material can be exhibited.

Although the color development time is not particularly limited, it is preferably about 10 sec to 2 min, particularly about 15 sec to 1 min 30 sec, since the process is to be rapidly conducted in a rapid automatic processing machine.

In the processing machine of the present invention, the development is followed by the desilverization. The desilverization steps in the present invention are as shown below, which do not limit the invention:

(step 1) bleaching/fixing (step 2) bleach-fixing (step 3) bleaching/bleach-fixing (step 4) bleaching/bleach-fixing/fixing (step 5) fixing/bleach-fixing, and (step 6) fixing.

In each of the bleaching step, bleach-fixing step and fixing step, the bath may be partitioned into two or more baths to conduct the process in a cascade system.

Various bleaching agents are usable for preparing the bleaching solution or bleach-fixing solution usable in the processing machine of the present invention. Examples of the bleaching agents include hydrogen peroxide, persulfates, potassium ferricyanide, bichromates, iron chloride salts and ferric aminopolycarboxylates. Particularly preferred bleaching agents are ferric aminopolycarboxylates.

Particularly preferred aminopolycarboxylic acids include, for example, EDTA, 1,3-PDTA, diethylenetriaminepentaacetic acid, 1,2-cyclohexanediaminetetraacetic acid, iminodiacetic acid, methyliminodiacetic acid, N-(2-acetamido) iminodiacetic acid, nitrilotriacetic acid, N-(2-carboxyethyl) iminodiacetic acid, N-(2-carboxymethyl)iminodipropionic acid, β-alanine, diethylenediamine-N,N'-disuccinic acid and 1,3-propylenediamine-N,N'-disuccinic acid.

The concentration of the ferric complex salts in the bleach-fixing solution of the present invention is in the range of 0.005 to 2.0 mol/l, preferably 0.01 to 1.00 mol/l, and more preferably 0.02 to 0.50 mol/l.

The concentration of the ferric complex salt in the replenisher is preferably 0.005 to 2 mol/l, more preferably 0.01 to 1.5 mol/l.

The bleaching solution, bleach-fixing solution and/or preprocessing bath can contain a bleaching accelerator selected from among various compounds. Preferred are, for example, compounds having a mercapto group or disulfide bond described in U.S. Pat. No. 3,893,858, German Patent No. 1,290,812, J. P. KOKAI No. Sho 53-95630 and Research Disclosure No. 17129 (July, 1978); thiourea compounds described in J. P. KOKOKU No. Sho 45-8506, J. P. KOKAI Nos. Sho 52-20832 and 53-32735 and U.S. Pat. No. 3,706,561; and halides such as iodides and bromides, since they have a high bleaching power.

The bleaching solution or bleach-fixing solution usable in the present invention can contain a rehalogenating agent such as a bromide (e.g. potassium, sodium or ammonium bromide), chloride (e.g. potassium, sodium or ammonium chloride) or iodide (e.g. ammonium iodide). If necessary, one or more inorganic and organic acids and alkali metal or ammonium salts of them having a pH-buffering effect can be added to the solution. They include, for example, borax, sodium metaborate, acetic acid, sodium acetate, sodium carbonate, potassium carbonate, phosphorous acid, phosphoric acid, sodium phosphate, citric acid, sodium citrate and tartaric acid. Further, an anticorrosive agent such as ammonium nitrate or guanidine may be added to the solution.

The bleaching solution or bleach-fixing solution can contain a fluorescent brightener, antifoaming agent, surfactant or organic solvent such as polyvinylpyrrolidone or methanol.

A known fixing agent is used for the bleach-fixing solution or fixing solution. The fixing agents include thiosulfates such as sodium thiosulfate and ammonium thiosulfate; thiocyanates such as sodium thiocyanate and ammonium thiocyanate; thioether compounds such as ethylene bisthioglycolic acid and 3,6-dithia-1,8-octanediol; and water-soluble silver halide-solubilizers such as thioureas. They can be used either singly or in the form of a mixture of two or more of them. A special bleach-fixing solution comprising a combination of a fixing agent described in J. P. KOKAI No. Sho 55-155354 with a large amount of a halide such as potassium iodide can also be used. In the present invention, a thiosulfate, particularly ammonium thiosulfate, is preferably used. The amount of the fixing agent is in the range of preferably 0.3 to 2 mol, more preferably 0.5 to 1.0 mol, per liter.

The bleach-fixing solution or fixing solution preferably contains a preservative selected from among sulfite ion-releasing compounds, for example, sulfites (such as sodium, potassium and ammonium sulfites), hydrogensulfites (such as ammonium, sodium and potassium hydrogensulfites) and metabisulfites (such as sodium, potassium and ammonium metabisulfites). The amount of such a compound contained in the solution is preferably about 0.02 to 0.05 mol/l, more preferably 0.04 to 0.40 mol/l.

Although the sulfite is usually added as the preservative to the bleach-fixing solution or fixing solution, other compounds such as ascorbic acid, carbonyl bisulfite adducts and carbonyl compounds are also usable. Benzenesulfinic acids are also effective. If necessary, the bleach-fixing solution and fixing solution can contain a buffering agent, fluorescent brightener, chelating agent, anti-foaming agent, mildew-proofing agent and so on.

The pH range of the bleaching solution or bleach-fixing solution used in the present invention is preferably 3 to 10, more preferably 4 to 9.

In the processing machine of the present invention, the desilverization by fixing or bleach-fixing is usually followed by washing with water and/or stabilization.

In the steps of washing with water and/or stabilization, the above-described chlorine dioxide is most suitably used. The amount thereof is preferably about 1 to 100 ppm, most preferably about 2 to 50 ppm.

The amount of the replenisher in the step of washing with water and the stabilization step is not limited. It is usually about 50 ml to 5 l per square meter of the photosensitive material. In order to obtain the remarkable effect of the present invention, the amount of the replenisher is desirably as small as about 1.0 to 20 parts per part of the solution brought from the preceding bath. Since the amount of the solution brought from the preceding bath is usually about 50 ml per square meter of the photosensitive material, the actual amount of the replenisher is about 50 to 1,000 ml. It is more preferably about 2 to 10 parts per part of the solution brought from the preceding bath.

The water in the washing bath or the solution in the stabilization bath in the present invention contains at least $1\times10^{-4}$ mol/l, preferably $1\times10^{-3}$ to 0.5 mol/l, more preferably $5\times10^{-3}$ to 0.1 mol/l, of a thiosulfate. The thiosulfate may be directly added thereto or brought by the fixing solution or bleach-fixing solution from the preceding bath.

The remarkable effect of the present invention can be obtained when the average residence time of the solution in the washing-with-water tank or stabilization tank is in the range of one week to two months. The term "average residence time" indicates the average period of time in which the solution is kept in the tank. The average residence time corresponds to a number of days necessitated for feeding the replenisher in an amount equal to that of the solution in the tank. The term "amount of the solution in the tank" indicates the total capacity of the tanks when two or more washing-with-water tanks or stabilization tanks are used. From the viewpoint of the deterioration of the overall photographic properties, an excess average residence time is undesirable. For example, when it exceeds 2 months, the effect of the bath cannot be easily maintained. The most remarkable effect of delaying the formation of the precipitate by sulfurization of the solution in the chlorine dioxide-containing washing bath and/or stabilization bath can be obtained when the average residence time is in the range of one week to two months, particularly 10 days to one month.

The replenisher may be fed either continuously or intermittently. The solution used in the washing step and/or stabilization step may be used also in the preceding steps. For example, an overflow of the washing water or stabilizing solution is introduced in the preceding bleach-fixing bath by a multi-stage counter current system, and a concentrated solution is fed into the bleach-fixing bath to reduce the amount of the waste water.

The quantity of the water used in the washing step or the stabilizing solution in the stabilization step can be fixed in various ranges depending on the properties (variable depending on the substances used such as a coupler) of the photosensitive material, use of the material, solution temperature, number of the tanks (number of stages), replenishing method (countercurrent or following current) and other conditions. Usually 2 to 6 stages, particularly 2 to 4 stages, are preferred in the multistage countercurrent system.

The water very effectively usable for washing or stabilizing solution is prepared by reducing in amount of calcium and magnesium for inhibiting the propagation of bacteria as described in J. P. KOKAI No. Sho 62-288838.

The water used for washing can contain a surfactant as a hydro-extracting agent or a chelating agent such as EDTA as a softening agent for hard water.

The photosensitive material can be processed with a stabilizing solution after the step of washing with water or without this step. The stabilizing solution contains a compound capable of stabilizing the image such as an aldehyde compound, e.g. formalin, or aldehyde-releasing compound. The compounds include hexamethylenetetramine; N-methylolazoles such as N-methylolpyrazole described in Japanese Patent Application No. Hei 3-318644; and azolylmethylamines such as N,N'-bis(1, 2,4-triazol-1-yl) piperazine described in J. P. KOKAI No. Hei 4-313753. The stabilizing solution may contain a buffering agent for controlling the membrane to a pH suitable for stabilizing the dye, and an ammonium compound. If necessary, the stabilizing solution may contain a germicide and mildew-proofing agent for inhibiting the propagation of bacteria in the solution or for imparting the mildew-proofing properties to the processed photosensitive material.

Further, the stabilizing solution may contain a surfactant, fluorescent brightener and hardening agent. When the stabilization is directly conducted without the preceding step of washing with water in processing the photosensitive material in the present invention, any of known methods described in J. P. KOKAI Nos. Sho 57-8543, 58-14834, 60-220345 and so on can be employed.

In a preferred embodiment, a chelating agent such as 1-hydroxyethylidene-1,1-diphosphonic acid or ethylenediaminetetramethylenephosphonic acid, or a magnesium or bismuth compound is also used.

In the steps of washing with water and stabilization, the pH is preferably 4 to 10, more preferably 5 to 8. The temperature which varies depending on the use and properties of the photosensitive material is usually 15° to 45° C., preferably 20° to 40° C. Although the time is not particularly limited, the shorter, the better for obtaining the excellent effect of the invention. It is preferably 15 seconds to 1 minute 45 seconds, more preferably 15 seconds to 1 minute.

The processing composition usable in the present invention can be in various forms. The processing agent can be in the form of one concentrated solution or two or more concentrated solutions; or a powder. It can be in such a form that it is directly usable without necessitating any process. Further, the processing agent can be a combination of the concentrated solution, powder and the directly usable solution.

The description will be made on the photosensitive material usable in the present invention.

Any kind of the photosensitive materials can be processed by the present invention. The silver halide emulsions, other substances (such as additives), layers of the photographic structure (such as layer configuration), methods for processing the photosensitive materials, and additives used for the processing according to the present invention are preferably those described in the following patents, particularly European Patent No. 0,355,660 A2 (Japanese Patent Application No. Hei 1-107011):

TABLE 1

| Photographic constituent, etc. | J. P. KOKAI No. Sho 62-215272 |
|---|---|
| Silver halide emulsion | From line 6, right upper column, p. 10 to line 5, left lower column, p. 12; and from line 4 from below, right lower column, p. 12 to line 17, left upper column, p. 13 |
| Solvent for silver halide | Lines 6 to 14, left lower column, p. 12; and from line 3 from below, left upper column, p. 13 to the last line, left lower column, p. 18 |
| Chemical sensitizer | Line 3 from below, left lower column, p. 12; line 5 from below, right lower column, p. 12; and from line 1, right lower column, p. 18, to line 9 from below, right upper column, p. 22 |
| Spectral sensitizer (spectral sensitizing method) | From line 8 from below, right upper column, p. 22 to the last line, p. 38 |
| Emulsion stabilizer | From line 1, left upper column, p. 39 to the last line, right upper column, p. 72 |
| Development accelerator | From line 1, left lower column, p. 72 to line 3, right upper column, p. 91 |
| Color coupler (cyan, magenta or yellow coupler) | From line 4, right upper column, p. 91 to line 6, left upper column, p. 121 |
| Color development improver | From line 7, left lower column, p. 121 to line 1, right upper column, p 125 |

TABLE 2

| Photographic constituent, etc. | J. P. KOKAI No. Sho 62-215272 |
|---|---|
| Ultraviolet absorber | From line 2, right upper column, p. 125 to the last line, left lower column, p. 127 column, p. 127 |
| Decoloration inhibitor (image stabilizer) | From line 1, right lower column, p. 127 to line 8, left lower column, p. 137 |
| High boiling and/or low boiling organic solvent | From line 9, left lower column, p. 137 to the last line, right upper column, p. 144 |
| Dispersion method for photographic additive | From line 1, left lower column to line 7, right upper column, p. 146 |
| Antistaining agent | From line 9, right lower column, p. 188 to line 10, right lower column, p. 193 |
| Surfactant | From line 1, left lower column, p. 201 to the last line, right upper column, p. 210 |
| Fluorine-containing compound (as antistatic agent, coating assistant, lubricant, adhesion inhibitor, etc.) | Line 1, left lower column, p. 210; and line 5, left lower column, p. 222 |

TABLE 3

| Photographic constituent, etc. | J. P. KOKAI No. Sho 62-215272 |
|---|---|
| Binder (hydrophilic colloid) | From line 6, left lower column, p. 222 to the last line, left upper column, p. 225 |
| Thickening agent | From line 1, right upper column, p. 225 to line 2, right upper column, p. 227 |
| Antistatic agent | From line 3, right upper column, p. 227 to line 1, left upper column, p. 230 |
| Hardener | From line 8, right upper column, p. 146 to line 4, left lower column, p. 155 |
| Developing agent precursor | From line 5, left lower column, p. 155 to line 2, right lower column, p. 155 |
| Development inhibitor releasing compound | Lines 3 to 9, right lower column, p. 155 |
| Support | Line 19, right lower colulmn, p. 155; and line 14, left upper column, p. 156 |
| Constitution of photosensitive layers | From line 15, left upper column, p. 156 to line 14, right lower column, p. 156 |
| Dye | From line 15, right lower column, p. 156 to the last line, right lower column, p. 184 |
| Color mixing inhibitor | From line 1, left upper column, p. 185 to line 3, right lower column, p. 188 |
| Gradation controller | Lines 4 to 8, right lower column, p. 188 |
| Polymer latex | From line 2, left upper column, p. 230 to the last line, p. 239 |
| Matting agent | From line 1, left upper colum, p. 240 to the last line, right upper column, p. 240 |
| Photographic process (steps and additives) | From line 7, right upper column, p. 3 to line 5, right upper column, p. 10 |

Notes) The cited portions of J. P. KOKAI No. Sho 62-215272 includes also those amended by the Written Amendment dated March 16, 1987 as stated at the end of this patent publication.

Among the above-described couplers, preferred yellow couplers are so-called short-wave tyoe yellow couplers described in J. P. KOKAI Nos. Sho 63-231451. Sho 63-123047, Sho 63-241547, Hei 1-173499, 1-213648 and 1-250944.

TABLE 4

| Photographic constituent, etc. | J. P. KOKAI No. Hei 2-33144 | EP 0,355,660A2 |
|---|---|---|
| Silver halide emulsion | From line 16, right upper column, p. 28 to line 11, right lower column, p. 29; and lines 2 to 5, p. 30 | From line 53, p. 45 to line 3, p. 47; and lines 20 to 22, |

TABLE 4-continued

| Photographic constituent, etc. | J. P. KOKAI No. Hei 2-33144 | EP 0,355,660A2 |
|---|---|---|
| | | p. 47 |
| Chemical sensitizer | From line 12, right lower column, to the last line, p. 29 | Lines 4 to 9, p. 47 |
| Spectral sensitizer (spectral sensitizing method) | Lines 1 to 13, left upper column, p. 30 | Lines 10 to 15, p. 47 |
| Emulsion stabilizer | From line 14, left upper column to line 1, right upper column, p. 30 | lines 16 to 19, p. 47 |
| Color coupler (cyan, magenta or yellow coupler) | From line 14, right upper column, 3 to the last line, lsft upper column, p. 18; and from line 6, right upper column, p. 30 to line 11, right lower column, p. 35 | Lines 15 to 27, p. 4; from line 30, p. 5 to the last line, p. 28; lines 29 to 31, p. 45; and from line 23, p. 47 to line 50, p. 63 |
| Ultraviolet absorber | From line 14, right lower column, p. 37 to line 11, left upper colum, p. 38 | Lines 22 to 31, p. 65 |
| Decoloration inhibitor (image stabilizer) | From line 12, right upper column, p. 36 to line 19, left upper column, p. 37 | From line 30, p. 4 to line 25, p. 45; lines 33 to 40, p. 45; and lines 2 to 21, p. 65 |
| High boiling and/or low boiling organic solvent | From line 14, right lower column, p. 35 to line 4 from below. left upper column, p. 36 | Lines 1 to 51, p. 64 |
| Dispersion method for photographic additive | From line 10, right lower column, p. 27 to the last line, left upper column, p. 28; and from line 12, right lower column, p. 35 to line 7, right upper column, p. 36 | From line 51, p. 63 to line 56, p. 64 |
| Antistaining agent | The last line, left upper colum, p. 37 and line 13, right lower column, p. 37 | From line 32, P. 65 to line 17, p. 66 |

TABLE 5

| Photographic constituent, etc. | J. P. KOKAI No. Hei 2-33144 | EP 0,355,660A2 |
|---|---|---|
| Surfactant | Form line 1, right upper column, p. 18 to the last line, right lower column, p 24; and from line 10 from below, left lower column, p. 27 to line 9, right lower column, p. 27 | — |
| Fluorine-containing compound (as anti-static agent, coating assistant, lubricant, adhesion inhibitor, ect.) | Line 1, left upper column, p. 25 to line 9, right upper column, p. 27 | — |
| Binder (hydrohilic colloid) | Lines 8 to 18, right upper column, p. 38 | Lines 23 to 28, p. 66 |
| Support | From line 18, right upper column, p. 38 to line 3, left upper dolumn, p. 39 | From line 29, p. 66 to line 13, p. 67 |
| Constitution of photosensitive layers | Lines 1 to 15, right upper column, p. 28 | Lines 41 to 52, p. 45 |
| Dye | From line 12, left upper column to line 7, right upper column, p. 38 | Lines 18 to 22, p. 66 |
| Color mixing inhibitor | Lines 8 to 11, right upper column, p. 36 | From line 57, p. 64 to line 1, p. 65 |
| Photographic process (steps and aditives | From line 4, left upper column, p 39 to the last line, left upper column, p. 42 | From line 14, p. 67 to line 28, p. 69 |

Various silver halide emulsions such as silver bromoiodide, silver chloroiodide, silver chlorobromoiodide, silver chlorobromide, silver bromide and silver chloride emulsions can be used in the present invention. The photosensitive material has preferably at least one emulsion layer containing silver halide grains comprising at least 90 molar %, more preferably 95 to 99.0 molar %, and most preferably 98 to 99.9 molar % of silver chloride. Particularly preferred is that the whole layer comprises a silver chlorobromide emulsion comprising 98 to 99.9 molar % of silver chloride. Although the amount of silver to be used for preparing the photosensitive material is not particularly limited, it is preferably about 0.2 to 15 g/m$^2$, particularly about 0.4 to 5.0 g/m$^2$.

When the photosensitive material used in the present invention is a color photosensitive material, various couplers can be incorporated thereinto. The details are given in Table 2.

Preferred cyan couplers include diphenylimidazole cyan couplers described in J. P. KOKAI No. Hei 2-33144, as well as 3-hydroxypyridine cyan couplers described in European Patent No. 0,333,185 A2 [particularly preferred are a cyan coupler prepared by converting a four-equivalent coupler (42) into a two-equivalent one by introducing a chlorine-linked coupling-off group, and couplers (6) and (9) mentioned therein], and cyclic active methylene cyan couplers described in J. P. KOKAI No. Sho 64-32260 (particularly preferred are Couplers 3, 8 and 34 mentioned therein).

It is preferred that a dye (particularly an oxonol dye) which can be decolored by a process as described on pages 27 through 76 of European Patent No. 0,337,490 A2 is incorporated into the hydrophilic colloid layer in such a manner that the optical reflection density of the photosensitive material will be 0.70 or above at 680 nm in order to improve the sharpness of the image, or that at least 12% by weight (more desirably at least 14% by weight) of titanium oxide surface-treated with a dihydric to tetrahydric alcohol (such as trimethylolethane) is incorporated into a water-resistant resin layer of the support.

The photosensitive material for color photography of the present invention preferably contains a compound for improving the dye stability as described in European Patent No. 0,277,589 A2 in addition to the coupler, particularly preferably a pyrazoloazole coupler.

To inhibit the staining caused by a dye formed by, for example, the reaction of the color developing agent or an oxidation product thereof remaining in the membrane with the coupler and other side effects during the storage after the process, it is preferred to use a compound (F) which can be chemically bonded with an aromatic amine developing agent remaining after the color development to form a chemically inert, substantially colorless compound and/or a compound (G) which can be chemically bonded with an oxidation product of the aromatic amine developing agent remaining after the color development to form a chemically inert, substantially colorless compound.

A mildew-proofing agent as described in J. P. KOKAI No. Sho 63-271247 is preferably incorporated into the photosensitive material of the present invention in order to prevent the propagation of fungi and bacteria in the hydrophilic colloid layer, since they deteriorate the image.

The remarkable effect of the present invention can be obtained when the dry film thickness of the silver halide photosensitive material of the present invention for color photography excluding the support is 25 μm or below, preferably 5 to 20 μm and most preferably 6 to 17 μm. The thickness of the film can be reduced by reducing the amount of the gelatin, silver, oil, coupler, etc. The reduction of the amount of gelatin is most preferred. The film thickness can be determined by an ordinary method after leaving the sample to stand at 25° C. at 60 RH % for two weeks.

To improve the stain prevention and image preservation, the degree of swelling of the photographic layers of the silver halide color photographic material used in the invention is preferably 1.5 to 4.0, particularly 1.5 to 3.0. The term "degree of swelling" herein indicates a value obtained by dividing the thickness of the photographic layers after immersing the color photosensitive material in distilled water of 33° C. for 2 minutes by the thickness of the dry photographic layers.

The term "photographic layers" indicate layers composed of at least one photosensitive silver halide emulsion layer laminated with hydrophilic colloid layers, the former layer and the latter layers are water-permeable between each other. The photographic layers do not include a back layer provided on the support on an opposite side to the photographic photosensitive layers. The photographic layers comprise usually two or more layers participating in the formation of a photographic image, namely, a silver halide emulsion layer, intermediate layer, filter layer, antihalation layer and protecting layer.

The degree of swelling can be controlled as described above by any method. For example, it can be controlled by varying the amount and kind of the gelatin and those of the hardener used for the photographic film or by varying the drying conditions and leaving-to-stand conditions after forming the photographic layers. Although gelatin is advantageously used for forming the photographic layers, other hydrophilic colloids are also usable. For example, various hydrophilic macromolecular substances can be used such as gelatin derivatives; graft polymers of gelatin and another polymer; proteins such as albumin and casein; cellulose derivatives such as hydroxyethylcellulose, carboxymethylcellulose and cellulose sulfate; saccharide derivatives such as sodium alginate and starch derivatives; and homopolymers or copolymers such as polyvinyl alcohol, partial acetal of polyvinyl alcohol, poly-N-vinylpyrrolidone, polyacrylic acid, polymethacrylic acid, polyacrylamide, polyvinylimidazole and polyvinylpyrazole.

The gelatins usable herein include gelatin treated with lime or an acid, gelatin hydrolyzate and enzymatic decomposition products of gelatin. The gelatin derivatives are obtained by reacting gelatin with a compound selected from among various acid halides, acid anhydrides, isocyanates, bromoacetic acid, alkanesultones, vinylsulfonamides, maleinimide compounds, polyalkylene oxides and epoxy compounds.

The graft polymers of gelatin usable herein include those obtained by grafting a homopolymer or copolymer of a vinyl monomer such as acrylic acid, methacrylic acid or a derivative thereof, e.g. an ester or amide thereof, acrylonitrile or styrene onto gelatin. Preferred are graft polymers of gelatin with a polymer which is compatible with gelatin to some extent such as a polymer of acrylic acid, methacrylic acid, acrylamide, methacrylamide or hydroxyalkyl methacrylate. Examples of them are given in U.S. Pat. Nos. 2,763,625, 831,767, 2,956,884 and so on. Typical synthetic hydrophilic macromolecular substances are described in, for example, West German Patent Application (OLS) No. 2,312,708, U.S. Pat. Nos. 3,620,751 and 3,879,205 and J. P. KOKOKU No. Sho 43-7561.

The hardening agents include, for example, chromium salts (such as chromium alum and chromium acetate), aldehydes (such as formaldehyde, glyoxal and glutaraldehyde), N-methylol compounds (such as dimethylolurea and methyloldimethylhydantoin), dioxane derivatives (such as 2,3-dihydroxydioxane), active vinyl compounds {such as 1,3,5-triacryloyl-hexahydro-s-triazine, bis(vinylsulfonyl) methyl ether and N,N'-methylenebis-[β-(vinylsulfonyl) propionamide]}, active halogen compounds (such as 2,4-dichloro-6-hydroxy-s-triazine), mucohalogenic acids (such as mucochloric acid and mucophenoxychloric acid), isoxazoles, dialdehyde starch and 2-chloro-6-hydroxytriazinylated gelatin. They can be used either singly or in combination of them.

Preferred hardening agents are the aldehydes, active vinyl compounds and active halogen compounds.

The support for the photosensitive material of the present invention may be a white polyester support for display or a support having a white pigment-containing layer formed thereon on the same side as the silver halide emulsion layer. It is preferred to form an antihalation layer on the support on the same side as the silver halide emulsion layer or on the opposite side in order to further improve the sharpness. The transmission density of the support is controlled preferably in the range of 0.35 to 0.8 so that the display can be seen with a reflected light or transmitted light.

The photosensitive material of the present invention may be exposed to a visible light or infrared light. The exposing method may be either a low illuminance exposure or a high-illuminance short-time exposure. In the latter, a laser scanning exposing method wherein the exposure time per picture element is shorter than $10^{-4}$ second is preferred.

In the exposure, a band stop filter described in U.S. Pat. No. 4,880,726 is preferably used in order to remarkably improve the color reproducibility by avoiding the optical color mixing.

The processing method of the present invention can be employed for various photosensitive materials such as color negative films, color negative papers, color reversal papers, autopositive papers, color reversal films, negative films for movies, positive films for movies, roentgen films, reprophotographic films such as lith films, and black-and-white negative films. Particularly preferred are color negative films and color negative papers.

The following Exmples will further illustrate the present invention, which by no means limit the invention.

EXAMPLE 1

Color developers I, II and III each having the following composition were prepared by changing the concentration of an aromatic primary amine as the color developing agent as follows:

| Color developer | I | II | III |
|---|---|---|---|
| Ethylenediaminetetraacetic acid (g) | 3.0 | 3.0 | 3.0 |
| Sodium catechol-3,5-disulfonate (g) | 0.3 | 0.3 | 0.3 |
| Sodium sulfite (g) | 0.2 | 0.2 | 0.2 |
| Potassium carbonate (g) | 30.0 | 30.0 | 30.0 |
| Potassium bromide (g) | 0.03 | 0.03 | 0.03 |
| Sodium chloride (g) | 6.0 | 6.0 | 6.0 |

-continued

| Color developer | I | II | III |
|---|---|---|---|
| N,N-Di(sulfoethyl)hydroxylamine (g) | 5.0 | 5.0 | 5.0 |
| Fluorescent brightener (WHITEX 4; Sumitomo Chemical Co., Ltd.) | 1.0 | 1.0 | 1.0 |
| N-Ethyl-N-(β-methanesulfonamidoethyl)-3-methyl-4-aminoaniline sulfate (mol) | 0.12 | 0.15 | 0.18 |
| Water add to | 1 l | 1 l | 1 l |
| pH (25° C.) | 10.05 | 10.05 | 10.05 |

The chemical resistance tests of various materials given in Table 6 were conducted with the above-mentioned color developer at 38° C. and 40° C. by using Yamazaki stress relaxation tester YSR-8. Since the necessitated load varies depending on the part of the material used, the load was given in terms of the ratio (S/So) of the stress (S) which reduced with time to the initial stress (So) which was the initial load in the experiment.

Since the stress relaxation time cannot be compared simply with each other because of the variety of the material and initial stress, four patterns of the stress relaxation are given in Table 1. Namely, four typical patterns a to d are given in FIG. 1.

In FIG. 1, the pattern a indicates that the results are almost the same as those obtained in the absence of the processing chemical in air or distilled water under the same conditions. These results indicate that the deterioration with time is low enough and the resin is sufficiently usable.

The pattern b indicates that although the stress relaxation slightly proceeds, it has the relaxation limit and the relaxation velocity becomes low. Although the resin can be used as a material for only some parts if the parts are designed taking the degree of stress relalxation into consideration, the use of the material having a stress ratio of below 0.5 should be avoided, since its deformation is serious.

The pattern c indicates that the polymer structure is continuously weakened by chemical change and heat and the polymer is gradually cut off. The use of this resin is difficult.

The pattern d indicates that the stress is rapidly reduced by the environmental stress cracking. The resin cannot be used under the processing conditions of the present invention.

The durability of each of the resins to the color developer of the present invention was evaluated by the above-described process to obtain the results given in Table 6.

TABLE 6

| No | Material | Abbreviation or common name | Trade Name | Color developer 38° C. I | 38° C. II | 38° C. III | 40° C. I | 40° C. II | 40° C. III | Remarks |
|---|---|---|---|---|---|---|---|---|---|---|
| 1 | Polyacetal | POM | DELRIN | b | b | b | b | c | d | Comp. Ex. |
| 2 | Polycarbonate | PC | LEXAN | b | b | c | c | d | d | " |
| 3 | Polyarylate | PAR | U POLYMER | b | b | b | b | c | d | " |
| 4 | " | PAR | VECTRAN | a | b | b | b | d | d | " |
| 5 | Liquid crystal polymer | LCP | EKONOL | a | b | b | b | c | d | " |
| 6 | High-density polyethylene | HDPE | SUMIKATHENE | a | a | a | a | b | c | " |
| 7 | Rigid polyvinyl chloride | PVC | HISHIPLATE | a | a | a | a | b | c | " |
| 8 | Polyphenylene oxide | Modified PPE | XYRON | a | a | a | a | a | a | Present invention |
| 9 | " | Modified PPO | NORYL | a | a | a | a | a | a | " |
| 10 | " | Modified PPE | IUPIACE | a | a | a | a | a | a | " |
| 11 | Polyphenylene sulfide | PPS | RYTON | a | a | a | a | a | a | " |
| 12 | Polymethylpentene | PMP | TPX | a | a | a | a | a | a | " |
| 13 | Polyether ether ketone | PEEK | VICTREX | a | a | a | a | a | b | " |
| 14 | Polybutylene terephthalate | PBT | PLANAC | a | a | a | a | a | b | " |
| 15 | Polyethylene terephthalate | PET | FR-PET | a | a | a | a | a | b | " |
| 16 | Polyetherimide | PEI | ULTEM | a | a | a | a | a | b | " |
| 17 | Polyethersulfone | PES | PES | a | a | a | a | a | b | " |
| 18 | Polysulfone | PSF | UDEL | a | a | a | a | a | b | " |

When the resin (Nos. 8 to 18) of the present invention is used, the sufficient durability is obtained even when the color developer (40° C./ II or III) of the invention is used. Particularly, polyphenylene oxide and polymethylpentene are preferably used.

EXAMPLE 2

The durability tests of the resins were conducted in the same manner as that of Example 1 except that color developers IV, V and VI each having the following composition were used:

| Color developer | IV | V | VI |
|---|---|---|---|
| Diethylenetriaminepentaacetic acid (g) | 2.0 | 2.0 | 2.0 |
| 1-Hydroxyethylidene-1,1-diphosphonic acid (g) | 2.0 | 2.0 | 2.0 |
| Sodium sulfite (g) | 3.9 | 3.9 | 3.9 |
| Potassium carbonate (g) | 37.5 | 37.5 | 37.5 |
| Potassium bromide (g) | 1.4 | 1.4 | 1.4 |
| Potassium iodide (g) | 1.3 | 1.3 | 1.3 |
| Hydroxylamine sulfate (g) | 2.4 | 2.4 | 2.4 |
| N-Ethyl-N-(β-hydroxyethyl)-3-methyl-4-aminoaniline sulfate (mol) | 0.13 | 0.25 | 0.60 |
| Water add to | 1 l | 1 l | 1 l |
| pH (25° C.) | 10.05 | 10.05 | 10.05 |

The durability of each resin was evaluated with the above-mentioned color developer in the same manner as that of Example 1. The results are given in Table 7.

TABLE 7

| No. | Material | Symbol or common name | Trade name |
|---|---|---|---|
| 21 | Liquid crystal polymer | LCP | EKONOL |
| 22 | High-density polyethylene | HDPE | SUMIKATHENE |
| 23 | Rigid polyvinyl chloride | PVC | HISHIPLATE |
| 24 | Polyphenylene oxide | Modified PPE | XYRON |
| 25 | " | Modified PPO | NORYL |
| 26 | " | Modified PPE | IUPIACE |
| 27 | Polyphenylene sulfide | PPS | RYTON |
| 28 | Polymethylpentene | PMP | TPX |

| | Color developer | | | | | | |
|---|---|---|---|---|---|---|---|
| | 38° C. | | | 45° C. | | | |
| No. | IV | V | VI | IV | V | VI | Remarks |
| 21 | a | a | b | b | c | d | Comp. Ex. |
| 22 | a | a | b | b | c | d | " |
| 23 | a | a | a | a | c | d | " |
| 24 | a | a | a | a | a | a | Present invention |
| 25 | a | a | a | a | a | a | " |
| 26 | a | a | a | a | a | a | " |
| 27 | a | a | a | a | a | b | " |
| 28 | a | a | a | a | a | b | " |

It is apparent from Table 7 that the resins of the present invention were scarcely deteriorated and the excellent results were obtained, while the durability of the conventional resins was seriously reduced by the elevation of the temperature or by increase in amount of the developing agent (Nos. 21 to 23).

EXAMPLE 3

A trial processing tank was produced from a modified PPO (Noryl) by ESF molding method. The trial tank will be referred to as "tank A". The surface roughness of the tank was determined with SURCOM 575A (a machine for measuring surface roughness and shape; a product of Tokyo Seimitsu Co., Ltd.) according to JIS B 0601-1982 to find that Ra was 5.2 μm and Rmax was 54.0 μm. Then the surface roughness was reduced by paper polishing treatment to obtain tanks B, C and D having different surface roughnesses.

The results of the measurement of the surface roughness are given in Table 9.

Figure 2A:
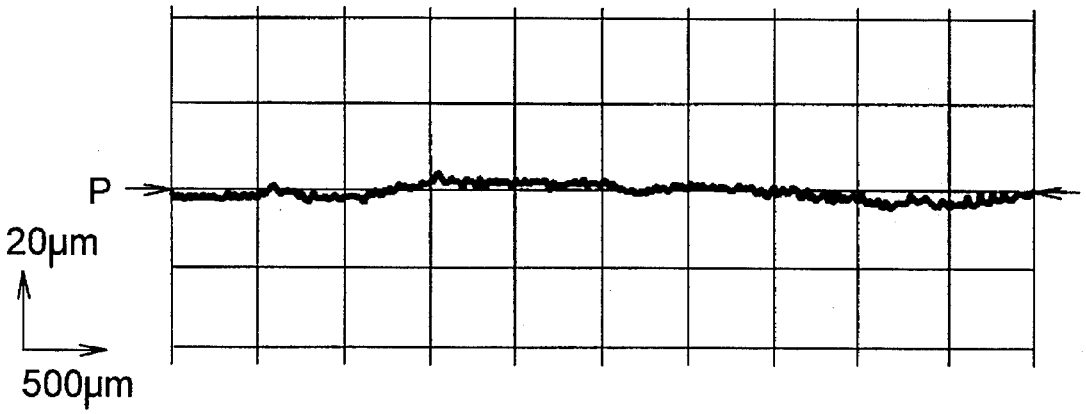
FIG. 2 are charts showing the measured surface roughness, in which the ordinates indicate the roughness and the abscissae indicate the horizontal direction (scan direction).
Figure 2B:
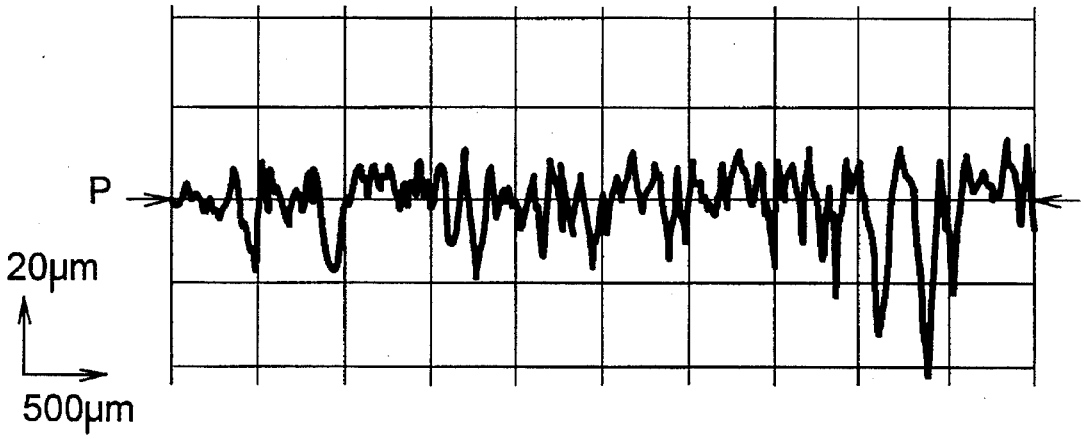

FIG. 2 is a chart showing the results of the measurement of the surface roughnesses of the tanks A and D. The data are given in Table 8.

TABLE 8

| Tank A Modified PPO SF-molded tank | | Tank D Modified PPO Paper-polished, SF molded tank | |
|---|---|---|---|
| ROUGHNESS | | ROUGHNESS | |
| CUTOFF | = 0.8 mm | CUTOFF | = 0.8 mm |
| TILT COR | = FLAT-ML | TILT COR | = FLAT-ML |
| LENGTH | = 5.00 mm | LENGTH | = 5.00 mm |
| V-MAG | = 500 | V-MAG | = 5000 |
| R-MAG | = 20 | H-MAG | = 20 |
| T-SPEED | = 0.3 mm/s | T-SPEED | = 0.3 mm/s |
| POLARITY | = POSITIVE | POLARITY | = POSITIVE |
| Ra | = 5.2 μm | Ra | = 0.44 μm |
| Rmax | = 54.0 μm | Rmax | = 7.04 μm |
| Rz | = 37.4 μm | Rz | = 2.12 μm |
| RMS | = 7.0 μm | RMS | = 0.52 μm |

(Notes)
Ra: average center line roughness,
Rmax: maximum height,
Rz: average + point roughness,
RMS: mean square roughness.

Then tanks E to H having diffirent surface roughnesses were produced from rigid polyvinyl chloride (PVC) in the same manner as that described above. The color developer I, II or III in Example 1 was fed into the tank. After leaving them to stand at 42° C. for one week, the height of the rise of the crystals from the liquid surface level was determined. The solution was replenished everyday to keep the level constant, since it vaporized.

The results are given in Table 9.

TABLE 9

| | | Surface roughness(μm) | | Rise (mm) | | | |
|---|---|---|---|---|---|---|---|
| No | Tank | Ra | Rmax | Developer I | Developer II | Developer III | Remarks |
| 31 | A | 5.2 | 54.0 | 18.9 | 21.8 | 23.3 | Present invention |
| 32 | B | 4.5 | 45.3 | 9.2 | 11.0 | 12.3 | " |
| 33 | C | 2.5 | 15.0 | 6.9 | 7.3 | 8.1 | " |
| 34 | D | 0.44 | 7.04 | 4.0 | 4.1 | 4.1 | " |
| 31 | E | 5.4 | 55.3 | 38.9 | 39.8 | 39.4 | Comp. Ex. |
| 32 | F | 4.2 | 43.4 | 33.4 | 32.1 | 31.1 | " |
| 33 | G | 2.6 | 17.5 | 29.8 | 29.5 | 30.1 | " |
| 34 | H | 0.43 | 8.02 | 25.7 | 25.1 | 25.0 | " |

When the modified PPO of the present invention was used, the preferred results were obtained. Particularly, when the resin had a surface roughness of Ra of 5 μm or below and Rmax of 50 μm or below, the deposition of the crystals was advantageously reduced to 50% or less.

EXAMPLE 4

10 l developing tanks were produced from four kinds of resins with the same molds by ESF molding method. The molds of three sizes were used so that the basic thickness of the tanks would be 2.5, 3.0 or 4.0 mm. Thus, the tanks having three kinds of thicknesses were produced from polycarbonate (LEXAN), high-density polyethylene (Sumikathene), polyphenylene oxide (XYRON) and polyetherimide (ULTEM).

The color developer V described in Example 2 was fed into the developing tanks thus produced. After leaving them to stand at 38° C. or 45° C. for 3 months, the crack formation and change in quantity of the developer in the tank were determined. The results are given in Table 10.

TABLE 10

| No | Material for tank | Thickness mm | Crack formation 38° C. | Crack formation 45° C. | Volume change (L) 38° C. | Volume change (L) 45° C. | Remarks |
|---|---|---|---|---|---|---|---|
| 41 | Polycarbonate | 2.5 | ○ | X | 0.23 | — | Comp. Ex. |
| 42 | " | 3.0 | ○ | Δ | 0.21 | 0.46 | " |
| 43 | " | 3.5 | ○ | Δ | 0.19 | 0.42 | " |
| 44 | High-density polyethylene | 2.5 | ○ | X | 0.21 | — | " |
| 45 | " | 3.0 | ○ | Δ | 0.19 | 0.48 | " |
| 46 | " | 3.5 | ○ | Δ | 0.17 | 0.44 | " |
| 47 | Polyphenylene oxide | 2.5 | ○ | Δ | 0.12 | 0.12 | Present invention |
| 48 | " | 3.0 | ○ | ○ | 0.09 | 0.10 | " |
| 49 | " | 3.5 | ○ | ○ | 0.08 | 0.09 | " |
| 50 | Polyetherimide | 2.5 | ○ | Δ | 0.23 | 0.24 | " |
| 51 | " | 3.0 | ○ | ○ | 0.20 | 0.21 | " |
| 52 | " | 3.5 | ○ | ○ | 0.18 | 0.19 | " |

Crack formation: ○: No cracks were formed.
Δ Cracks were formed only slightly (no leakage of the solution).
X: Cracks were formed seriously to leak the solution.

It is apparent from Table 10 that when a comparative material is used (Nos. 41 to 46), some cracks were formed after leaving to stand particularly with the color developer of 45° C., and the content of the tank was significantly increased due to the flexure of the shape of the tank. On the contrary, when the polyphenylene oxide or polyether imide (Nos. 47 to 52) of the present invention was used, cracks were scarcely formed after the storage at 45° C. and the change in capacity of the tank was only slight. Excellent results were obtained particularly when the thickness of the tank was at least 3 mm.

EXAMPLE 5

Figure 3:
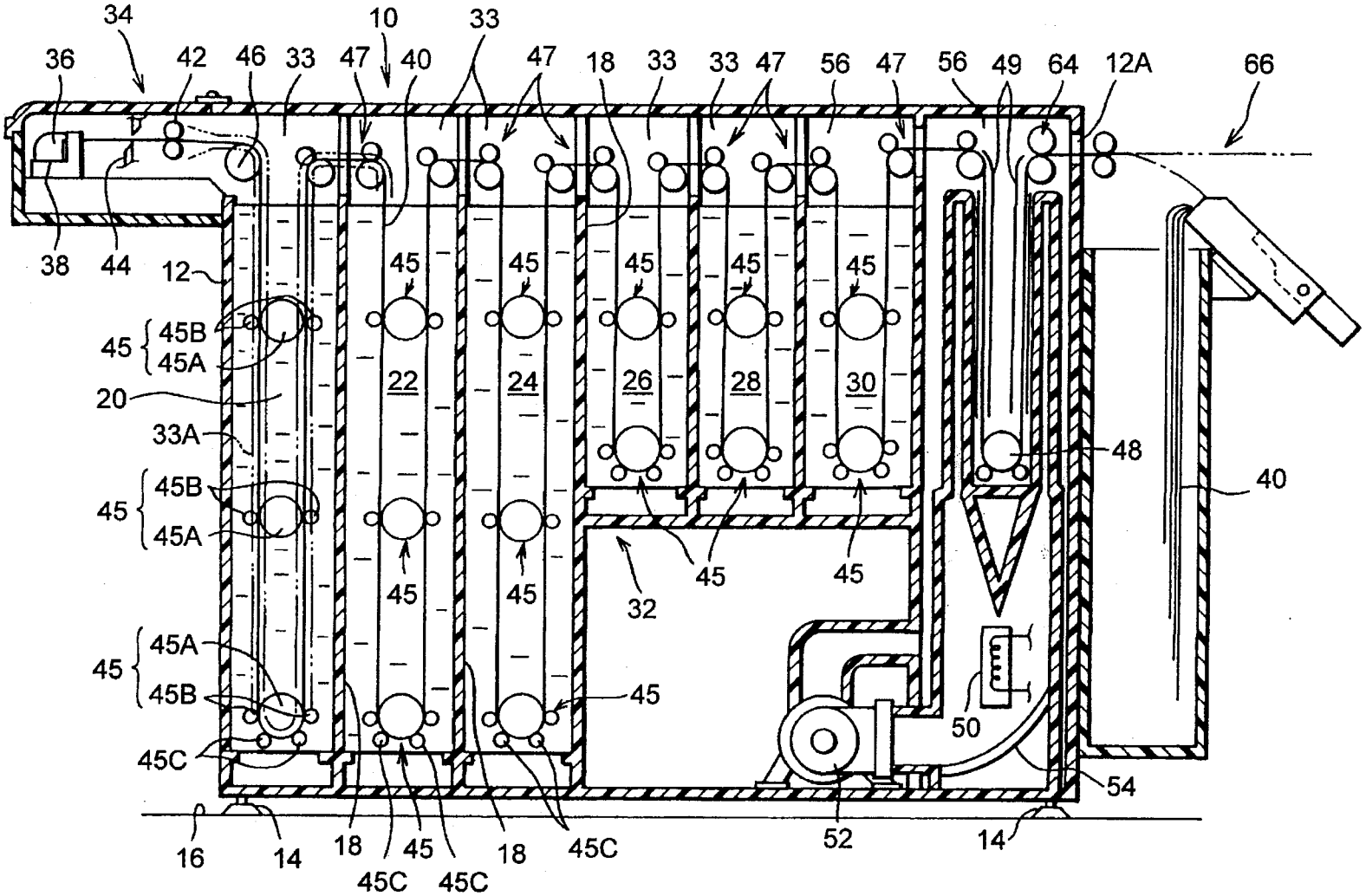
FIG. 3 is a schematic diagram of the automatic developing machine used in Example 5.

An automatic processor 10 for color films as shown in FIG. 3 was produced by ESF molding method by using polyphenylene oxide (XYRON) as the material for the tank having the basic thickness of 4.0 mm.

The automatic processor 10 was covered with a frame 12 to shield the light. The bottom of the flame 12 was supported with saddle supports on the floor 16.

Vertical walls 18 are formed from the bottom of the frame 12 to form a developing tank 20, bleaching tank 22, fixing tank 24, washing tanks 26 and 28 and stabilizing tank 30. Each tank contained a processing solution (the tanks will be generally called "processing tanks 32").

A film-mounting part 34 is provided on the left of the processing tanks 32 (developing tank 20). The film-mounting part 34 has a keepining part 38 for a cartridge 36. A negative film 40 in the cartridge 36 in the keepining part 38 is drawn out, then interposed between a pair of rollers 42 and carried into the processing tanks 32 with a roller 46. A cutter 44 is arranged at a downstream side of the keeping part 38 so that when the whole negative film 40 has been drawn out of the cartridge 36, it is cut with the cutter 44.

Each of the processing tanks 32 have a processing rack 33 most part (excluding the top) of which is immersed in processing solution.

As shown by the a two-dot chain line, a guide groove 33A for guiding the both crosswise edges of the negative film 40 is formed in the developing tank 20 in the processing rack 33. The guide groove 33A is provided also in the processing rack 33 in another processing tank 32. The negative film 40 is guided along the guide groove 33A in substantially U-shaped course in each of the processing tanks 32.

Carrier rollers 45 composed of a large-diameter roller 45A and a pair or small-diameter rollers 45B are positioned near the solution surface, near the bottom and an intermediate part between them in the processing rack 33 so that the negative film 40 guided along the guide groove 33A is kept between the rollers and carried.

The roller 45A, having large diameter, of the carrier roller 45 has additional two rollers 45C around it so that the negative film 40 can be stably turned.

A part of the processing rack 33, which is above the solution surface, is called "crossover part". This part is composed of a carrier roller 47 on the outlet and inlet sides of the two adjacent processing racks 33. The carrier rollers 47 are composed of a roller of a large diameter and that of a small diameter. The rollers 47 are for surely delivering the negative film 40 to the subsequent processing rack 33.

Thus the negative film 40 is processed with the respective processing solutions while it is guided along the guide groove 33A by the carrier roller 45 and carried in the substantially U-shaped course in the respective processing tanks 32. The film 40 is then discharged from the stabilizing tank 30 and delivered to the subsequent drying part 56.

There is a space below the stabilizing tank 30. A heater 50 and an air blower 52 are placed in the space. Hot air is fed into the drying part 56 on the downstream side in the processing tank 32 through a duct 54 with a hot air-feeding means.

In the drying part 56, the negative film 40 is guided through the U-shape course with a guide roller 48 and guide member 49. The film 40 is dryed by being exposed to the hot air while it is guided.

The negative film 40 thus dried in the drying part 56 is interposed between a pair of rollers 64, which is rotated by a driving force to send the film 40 into a discharging part 66.

Color negative films used were continuously processed by the following processing steps with the above-described automatic processor 10.

| Step | Temp. | Time | Amount of replenisher* |
|---|---|---|---|
| Color development | 45° C. | 1 min 30 sec | 10 ml |
| Bleaching | 40° C. | 1 min 30 sec | 5 ml |
| Fixing | 40° C. | 1 min 30 sec | 20 ml |
| Washing with water (1) | 38° C. | 30 sec | —** |
| Washing with water (2) | 38° C. | 30 see | 20 ml |
| Stabilization | 38° C. | 30 sec | 20 ml |
| Drying | 50 to 60° C. | 30 sec | |

*replenisher per roll of 24-EXP film.
**cascade system from washing step (2) to (1).

The compositions of the processing solutions used were as follows:

| | Mother liquid | Replenisher |
|---|---|---|
| Diethylenetriaminepentaacetic acid (g) | 2.0 | 2.0 |
| 1-Hydroxyethylidene-1,1-diphosphonic acid (g) | 2.0 | 2.0 |
| Sodium sulfite (g) | 3.9 | 6.0 |
| Potassium carbonate (g) | 38 | 38 |
| Potassium bromide (g) | 1.8 | — |
| Potassium iodide (mg) | 1.7 | — |
| Hydroxylamine sulfate (g) | 2.5 | 4.5 |
| N-ethyl-N-(β-hydroxyethyl)-3-methyl-4-aminoaniline sulfate (mol) | 0.20 | 0.30 |
| Water | ad 1000 ml | 1000 ml |
| pH (25° C.) | 10.05 | 10.10 |

The bleaching solution, fixing solution and stabilizing solution were CN-16FA N2-R, N3-R and N4-R (products of Fuji Photo Film Co., Ltd.), respectively.

Water used for the washing was treated with an ion exchange resin to reduce the calcium and magnesium ion concentrations to 3 ppm or below before the use. 20 rolls of Super G-400 (Fuji Photo Film Co., Ltd.), 20 rolls of Gold-400 (Eastman Kodak Co., U.S.A.) and 10 rolls of XG-400 (Konica Corporation) were processed a day, and the running test was conducted for one month. No leakage or distortion of the tank was recognized, and the excellent photographic properties could be kept.

Thus, the developing machine of the present invention has an excellent durability and exerts no bad influence on the photographic properties in the course of the development.

What is claimed is:

1. A developing apparatus for color photography having at least a developing tank and a rack which comprises means for keeping the temperature of a color developer having a concentration of an aromatic primary amine developing agent of 0.15 to 0.50 mol/l in the developing tank in the range of 42° to 50° C., material for the developing tank being a resin selected from the group consisting of polyphenylene sulfide resin, polyphenylene oxide resin, polymethylpentene resin, polyether ether ketone resin, polyalkylene terephthalate resin, polyether imide resin, polyether sulfone resin and polysulfone resin.

2. The developing apparatus of claim 1, wherein the material is a resin selected from the group consisting of polyphenylene oxide resin, polyphenylene sulfide resin and polymethylpentene resin.

3. The developing apparatus of claim 1, wherein the surface roughness of the developing tank or rack in the developing apparatus is such that the center line roughness (Ra) is 5.0 μm or below and the maximum roughness (Rmax) is 50 μm or below.

4. The developing apparatus of claim 3, wherein the material for the developing tank is a polyphenylene oxide resin and the basic thickness of the tank is 3 mm to 30 mm.

5. A developing apparatus for color photography which comprises a developing tank having a bottom part, side wall and lid, the bottom part and/or side wall being made of a resin selected from the group consisting of polyphenylene oxide resin, polyphenylene sulfide resin, polymethylpentene resin, polyether ether ketone resin, polyalkylene terephthalate resin, polyether imide resin, polyether sulfone resin and polysulfone resin, and the surface roughness of the bottom part and side wall being such that the center line roughness (Ra) is 5.0 μm or below and the maximum roughness (Rmax) is 50 μm or below, and means for keeping the temperature of a color developer to be contained in the developing tank in the range of 40° to 50° C.

6. The developing apparatus of claim 5, wherein a color developer having a concentration of an aromatic primary amine developing agent of 0.15 to 0.50 mol/l is contained in the developing tank.

7. The developing apparatus of claim 5, wherein the developing tank has an inlet and an outlet for an image-wise exposed silver halide photosensitive material for color photography to be developed.

8. The developing apparatus of claim 7, wherein a rack is provided inside of the developing tank and the rack has means for carrying an image-wise exposed silver halide photosensitive material for color photography to be developed in the developing tank.

9. The developing apparatus of claim 8, wherein the means for carrying the photosensitive material comprises a carrier roller and a guide groove.

10. The developing apparatus of claim 8, wherein the bottom part and side wall of the developing tank and the rack are made of a resin selected from the group consisting of polyphenylene oxide resin, polyphenylene sulfide resin and polymethylpentene resin.

11. The developing apparatus of claim 5, wherein the lid of the developing tank is made of a resin selected from the group consisting of polyphenylene oxide resin, polyphenylene sulfide resin, polymethylpentene resin, polyether ether ketone resin, polyalkylene terephthalate resin, polyether imide resin, polyether sulfone resin and polysulfone resin.

12. A method for processing a silver halide photosensitive material for color photography which comprises the steps of entering an image-wise exposed silver halide photosensitive material for color photography into a developing tank, through an inlet thereof, of a developing apparatus for color photography comprising the developing tank having a bottom part, side wall and lid, the bottom part and side wall being made of a resin selected from the group consisting of polyphenylene oxide resin, polyphenylene sulfide resin, polymethylpentene resin, polyether ether ketone resin, polyalkylene terephthalate resin, polyether imide resin, polyether sulfone resin and polysulfone resin, and means for keeping the temperature of a color developer to be contained in the developing tank in the range of 42° to 50° C., developing the silver halide photosensitive material with a color developer having a concentration of an aromatic primary amine developing agent of 0.15 to 0.50 mol/l in the developing tank in the range of 42° to 50° C., and obtaining the thus-developed silver halide photosensitive material through the outlet of the developing tank.

13. The method of claim 12, wherein the color developer has a pH of 10.0 or higher.

14. The method of claim 12, wherein the color developer is substantially free from benzyl alcohol.

15. The method of claim 12, wherein the color developing is carried out for 10 seconds to 2 minutes.

* * * * *